US008991792B2

(12) United States Patent
Hedley

(10) Patent No.: US 8,991,792 B2
(45) Date of Patent: Mar. 31, 2015

(54) FENCE POST AND FENCE FORMED THEREFROM

(75) Inventor: Robert Ian Hedley, Buttaba (AU)

(73) Assignee: Justoy Pty Limited, Mount Thorley Via Singleton, NSW (AU)

( * ) Notice: Subject to any disclaimer, the term of this patent is extended or adjusted under 35 U.S.C. 154(b) by 714 days.

(21) Appl. No.: 13/128,380

(22) PCT Filed: Nov. 10, 2009

(86) PCT No.: PCT/AU2009/001456

§ 371 (c)(1),
(2), (4) Date: Jun. 29, 2011

(87) PCT Pub. No.: WO2010/051597

PCT Pub. Date: May 14, 2010

(65) Prior Publication Data

US 2011/0248229 A1 Oct. 13, 2011

(30) Foreign Application Priority Data

Nov. 10, 2008 (AU) ..... 2008905784

(51) Int. Cl.

| | |
|---|---|
| ***A01K 3/00*** | (2006.01) |
| ***E01F 7/00*** | (2006.01) |
| ***E01F 15/00*** | (2006.01) |
| ***E04H 17/20*** | (2006.01) |

(52) U.S. Cl.
CPC ..... *E04H 17/20* (2013.01)
USPC ..... 256/13; 405/63; 405/67

(58) Field of Classification Search
USPC ..... 256/13, 19, 48, 65.02, 65.14, 67, 256/DIG. 5; 405/60, 63, 66, 67, 68, 69, 71
See application file for complete search history.

(56) References Cited

U.S. PATENT DOCUMENTS

| | | | | |
|---|---|---|---|---|
| 68,232 | A | 8/1867 | Pitcher | |
| 567,333 | A | 9/1896 | Chandler | |
| 810,260 | A | 1/1906 | Bugby | |
| 934,999 | A * | 9/1909 | Cummings | 256/13 |
| 1,335,302 | A | 3/1920 | Stout | |
| 2,239,740 | A * | 4/1941 | Schlachter | 114/267 |
| 3,050,139 | A * | 8/1962 | Hayes | 175/7 |
| 4,190,381 | A * | 2/1980 | Knaus et al. | 405/72 |
| 4,300,856 | A * | 11/1981 | Magoon et al. | 405/66 |
| 2,861,182 | A | 10/1983 | Cunningham et al. | |
| 4,738,563 | A * | 4/1988 | Clark | 405/52 |
| 5,301,925 | A * | 4/1994 | Carlson | 256/13 |
| 6,612,550 | B2 * | 9/2003 | Foot | 256/1 |
| 6,827,618 | B1 * | 12/2004 | Hampton et al. | 441/80 |
| 6,877,456 | B2 * | 4/2005 | Metherell et al. | 114/241 |
| 7,140,599 | B1 * | 11/2006 | Spink | 256/13 |
| 2002/0056833 | A1 | 5/2002 | Foot | |
| 2009/0278101 | A1 * | 11/2009 | Connachan et al. | 256/1 |

FOREIGN PATENT DOCUMENTS

| | | | |
|---|---|---|---|
| AU | 36265/84 | A | 6/1986 |
| WO | WO2006/005163 | A1 | 1/2006 |
| WO | WO 2006005163 | A1 * | 1/2006 |

* cited by examiner

*Primary Examiner* — Michael P Ferguson
*Assistant Examiner* — Nahid Amiri
(74) *Attorney, Agent, or Firm* — Kilpatrick Townsend & Stockton LLP

(57) ABSTRACT

A fence post which is adapted to release from a substrate surface in the event of rising water or flood. A plurality of fence post(s) may be used to form a fence (FIG. 8). Each fence post includes an engaging mechanism at a first end thereof, which is adapted to release from a substrate surface in the event of rising water or flood, and, a retaining mechanism at a second end thereof to retain the post near its pre-released position, such that the fence posts may be easily re-installed after the flood has passed.

12 Claims, 10 Drawing Sheets

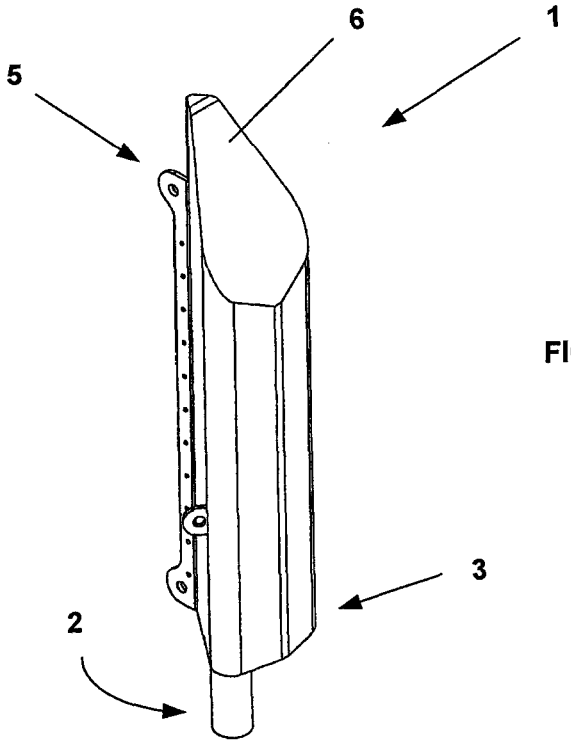
FIG. 1(a)
FIG. 1(b)
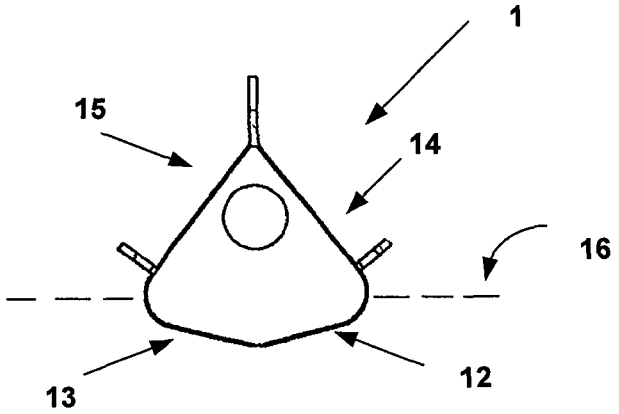

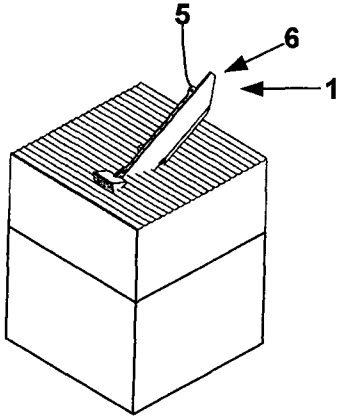
FIG. 3(c)(i)
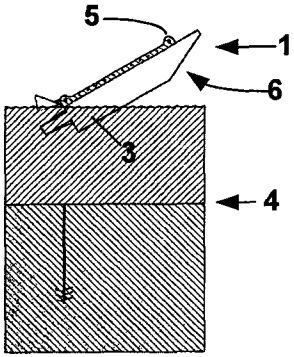
FIG. 3(c)(ii)
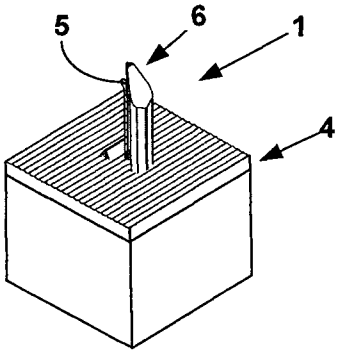
FIG. 3(b)(i)
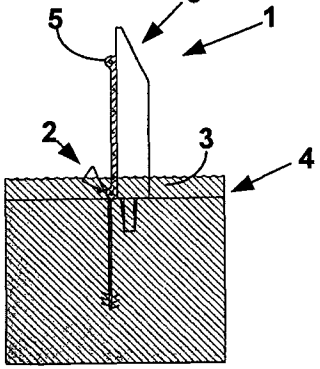
FIG. 3(b)(ii)
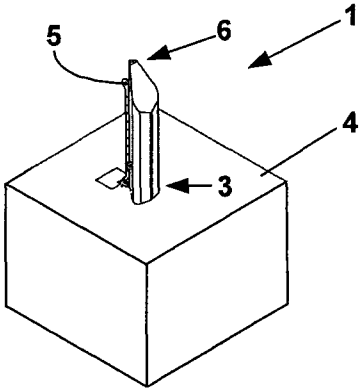
FIG. 3(a)(i)
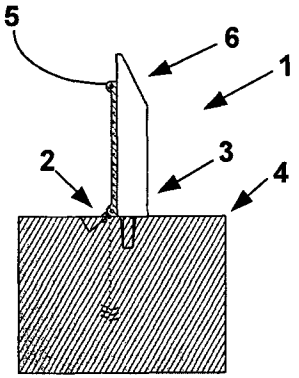
FIG. 3(a)(ii)

22
19
6
5
1

22
19
1
6
4
20
21
6
6
18

1
18

4
18
4
K
K
1
20
18

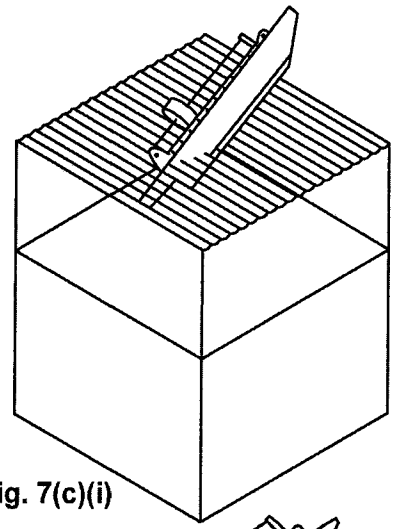
Fig. 7(c)(i)
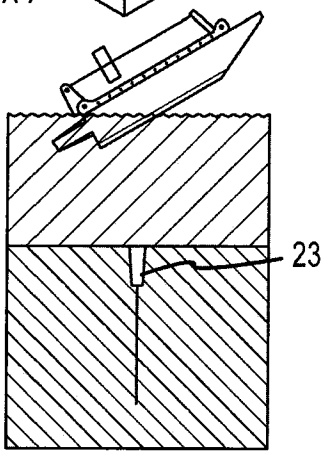
Fig. 7(c)(ii)
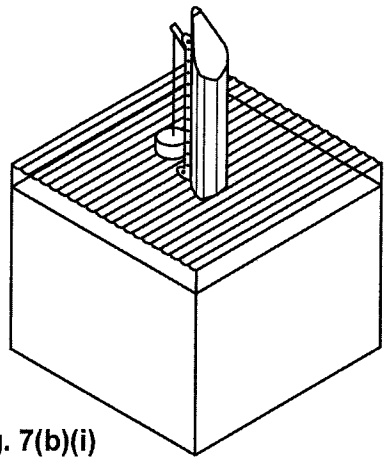
Fig. 7(b)(i)
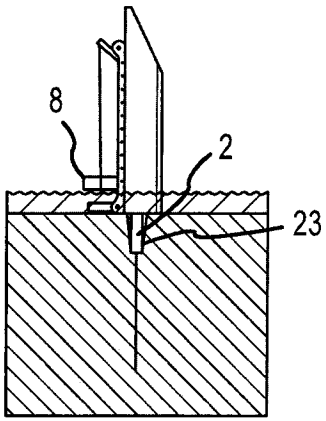
Fig. 7(b)(ii)
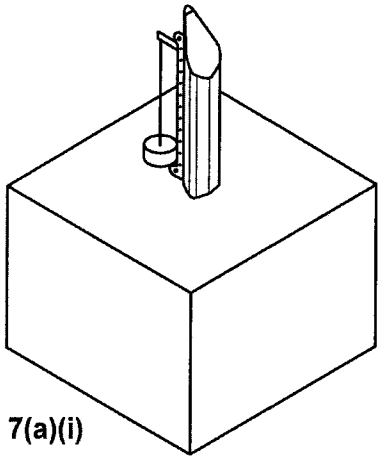
Fig. 7(a)(i)
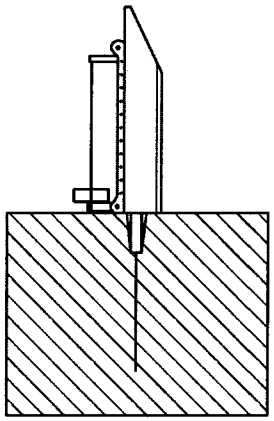
Fig. 7(a)(ii)

FENCE POST AND FENCE FORMED THEREFROM

BACKGROUND OF THE INVENTION

The present invention relates to a fence post which may be installed in situations prone to rising water or flood, and also, to a fence formed using a plurality of such fence posts.

DESCRIPTION OF THE PRIOR ART

The reference to any prior art in the specification is not and should not be taken as an acknowledgement or any form of suggestion that the prior art forms part of the common general knowledge.

In areas prone to flood, such as, but not limited to farms or other properties, it is not uncommon for fences on or around the farms or other properties to be substantially destroyed during floods and the like.

In such situations, not only does the water rise, but the water flow can sometimes be rapid in a direction from higher to lower ground, even on only slight inclines. Any debris, trees, shrubs, or other objects in the path of the moving and rising water is moved together with the flood waters as they travel. Such debris, trees, shrubs, and other objects tend to cause a considerable amount of damage when they contact any fixed item in their path.

Typically, when flood waters carrying debris, trees, shrubs, and other objects contact a fence in their pathway, the debris, trees, shrubs, and other objects become entangled in the fence. Depending upon the force of the flood waters, the fence may or may not withstand the forces exerted upon it by the debris, trees, shrubs, and other objects. In some situations, the debris and other matter is stalled by the fence, and after the flood waters recede, the debris and other matter is deposited along the fence line. In other situations, particularly in strong floods, the debris and other matter exerts such forces against the fence, that the fence typically gives way and breaks, allowing release of the debris and other matter. This situation is prone to be quite dangerous, especially where there has been significant build up of debris or other matter, as the debris or other matter is suddenly released and can cause quite a devastating effect on persons or objects downstream therefrom.

SUMMARY OF THE INVENTION

The present invention seeks to overcome some of the problems experienced by prior art fencing, especially during floods or rising waters.

In one broad form, the present invention provides a fence post which is adapted to release from a substrate surface in the event of rising water or flood.

Preferably, at least a part of said fence post is adapted to float in the event of rising water or flood.

Also preferably, the fence post further includes an engaging mechanism at a first end thereof, which is adapted to release said first end of said fence post from said substrate surface in the event of rising water or flood.

Preferably, the fence post further includes a retaining mechanism at a second end thereof, which, when said engaging mechanism releases said first end of said fence post from said substrate surface, substantially retains said second end of said post at or near its pre-released position.

Preferably, said retaining mechanism permits transverse movement of said post in at least one dimension.

Also preferably, the engaging mechanism of the fence post further includes a latch which is adapted to float, such that, in the event of rising water or flood, said latch is moved from a first position in which said fence post is secured to said substrate surface, to a second position in which said fence post is no longer secured to said substrate surface.

Preferably, said engaging mechanism includes a buoyant portion which is adapted to substantially float to effect operation of said engaging mechanism.

Also preferably, said engaging mechanism include a float connected thereto, said float being formed at least partly of buoyant material, to effect operation of said engaging mechanism.

Also preferably, the engaging mechanism of the fence post further includes:

an anchor, having a substrate engaging end which is secured substantially below said substrate surface; and, a latch engaging end which effectively enables said first end of said fence post to be secured to said substrate surface.

Preferably, said anchor is adapted to be received in a receiving mechanism, said receiving mechanism being anchored in said substrate surface.

Preferably, a body of said fence post is formed of hollow plastics or other lightweight floatable material.

Also preferably, said body of said fence post is shaped to be buoyant such that it assumes a substantially upright position when floating.

In a further broad form, the present invention provides a fence having a plurality of fence posts, at least one of said fence posts being a releasable fence post which is adapted to release from a substrate surface in the event of rising water or flood.

Preferably, each releasable fence post is adapted to float in the event of rising water or flood.

Also preferably, each releasable fence post includes an engaging mechanism at a first end thereof, which is adapted to release said first end of said releasable fence post from said substrate surface in the event of rising water or flood.

Also preferably, a retaining mechanism at a second end thereof, which, when said engaging mechanism releases said first end of said fence post from said substrate surface, substantially retains said second end of said post at or near its pre-released position.

The fence preferably also further includes:

a pair of spaced apart cable supports; and, a cable spanning said cable supports in a manner such that it is spaced above a substrate surface;

whereby, said retaining mechanism of each releasable fence post engages said cable.

In yet a further broad form, the present invention provides a fence having:

a pair of spaced apart cable supports;

a cable spanning said cable supports in a manner such that it is spaced above a substrate surface;

at least one releasable post positioned between said cable supports, each releasable post including:

engaging mechanism at a first end thereof, adapted to release said first end of said post from said substrate surface in the event of rising water or flood; and, a retaining mechanism at a second end thereof, adapted to hold said second end of said post to said cable when said first end of said post is released from said substrate.

Preferably, said engaging mechanism includes a latch which is adapted to float, such that, in the event of rising water or flood, said latch is moved from a first position in which said fence post is secured to said substrate surface, to a second position in which said fence post is no longer secured to said substrate surface.

Preferably, said engaging mechanism includes a buoyant portion which is adapted to substantially float to effect operation of said engaging mechanism.

Also preferably, said engaging mechanism includes a float connected thereto, said float being formed at least partly of buoyant material, to effect operation of said engaging mechanism.

Also preferably, said engaging mechanism further includes an anchor, having a substrate engaging end which is secured substantially below said substrate surface, and, a latch engaging end which effectively enables said first end of said fence post to be secured to said substrate surface.

Preferably, each said anchor is adapted to be received in a receiving mechanism, each said receiving mechanism being anchored in said substrate surface.

Preferably, a body of each releasable fence post is formed of hollow plastics or other lightweight floatable material.

Also preferably, said body of each releasable fence post is shaped to be buoyant such that it assumes a substantially upright position when floating.

BRIEF DESCRIPTION OF THE DRAWINGS

The present invention will become more fully understood from the following detailed description of preferred, but non-limiting embodiments thereof, described in connection with the accompanying drawings in which:

FIG. 1 (*a*) illustrates a perspective view of a first preferred embodiment of a fence post in accordance with the present invention;

FIG. 1(*b*) illustrates a top view of a first preferred embodiment of a fence post in accordance with the present invention;

FIGS. 3(*a*)(i) to 3(*c*)(ii) illustrate how the second embodiment of the fence post may be released, FIG. 3(*a*)(i) showing a perspective view of the fence post in a dry situation, FIG. 3(*a*)(ii) showing a side view of the fence post in a dry situation, FIG. 3(*b*)(i) illustrating a perspective view of the fence post in a situation where water is beginning to rise, and FIG. 3(*b*)(ii) illustrating a side view of the fence post in a situation where water is beginning to rise, FIG. 3(*c*)(i) illustrating a perspective view of the fence post in a situation of flood, and FIG. 3(*c*)(ii) illustrating a side view of the fence post in a situation of flood;

FIGS. 7(*a*)(i) to 7(*c*)(ii) illustrate how the third embodiment of the fence post may be released, FIG. 7(*a*)(i) showing a perspective view of the fence post in a dry river situation, FIG. 7(*a*)(ii) showing a side view of the fence post in a dry river situation, FIG. 7(*b*)(i) illustrating a perspective view of the fence post in a situation where water is beginning to rise, FIG. 7(*b*)(ii) illustrating a side view of the fence post in a situation where water is beginning to rise, FIG. 7(*c*)(i) illustrating the fence post in a situation of flood, and, FIG. 7(*c*)(ii) illustrating the fence post in a situation of flood;

DETAILED DESCRIPTION OF THE PREFERRED EMBODIMENTS

Figure 2A:
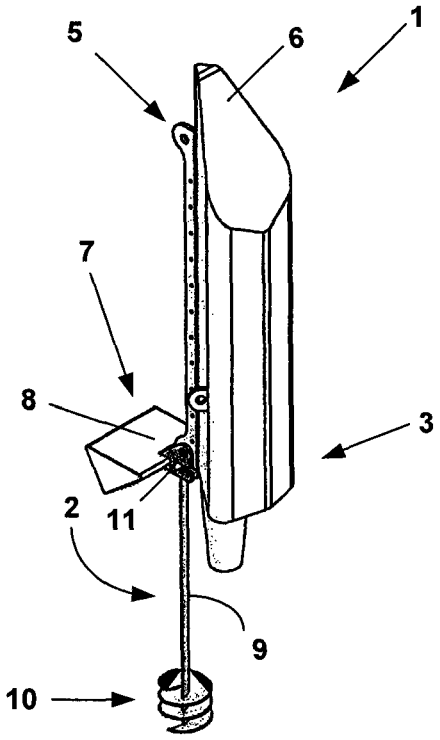
FIGS. 2(*a*) to 2(*e*) illustrate a second preferred embodiment of a fence post in accordance with the present invention, FIG. 2(*a*) showing a first perspective view, FIG. 2(*b*) showing a first side view, FIG. 2(*c*) showing a second perspective view, FIG. 2(*d*) showing a second side view, and FIG. 2(*e*) showing a perspective view of a fence post installed in a substrate.
Figure 2C:
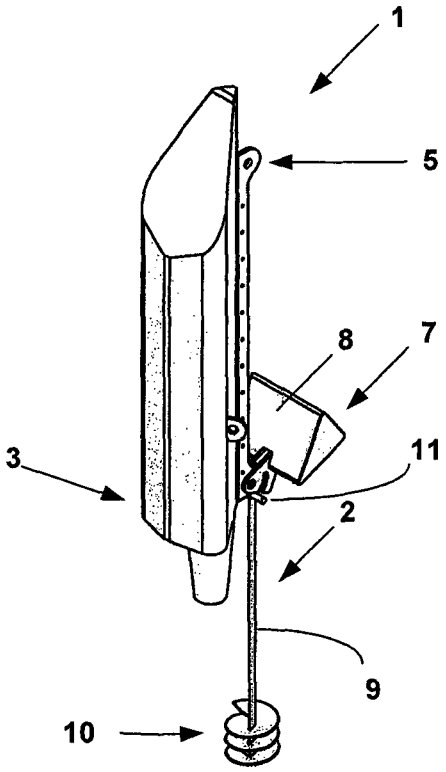
Figure 2B:
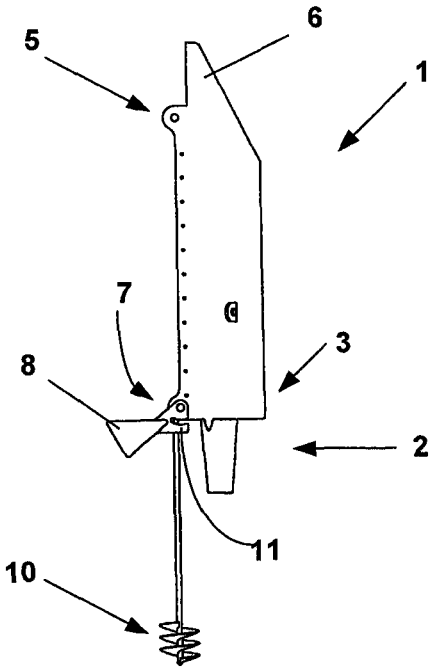
Figure 2D:
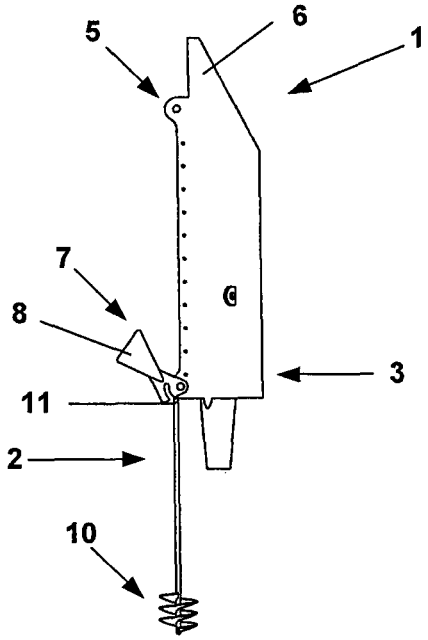
Figure 2E:
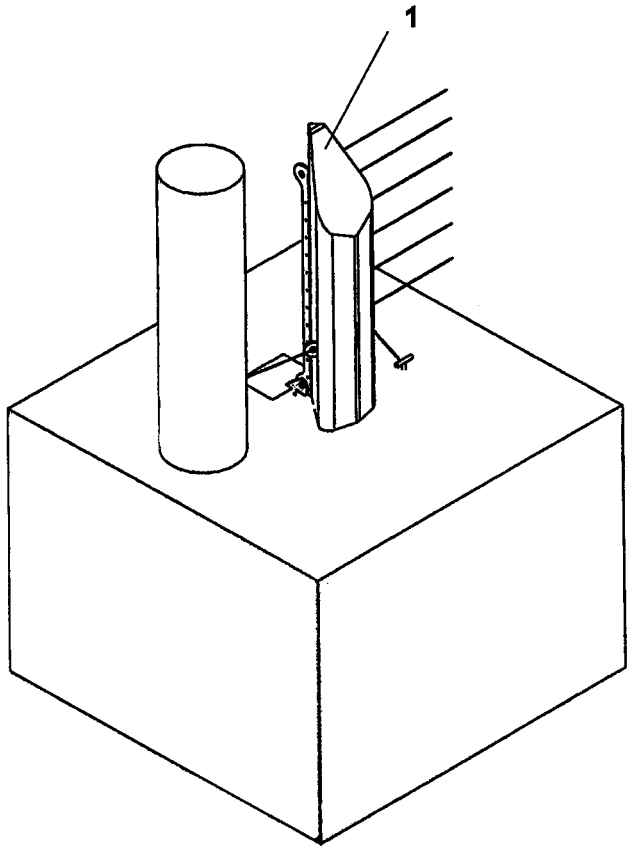

Throughout the drawings, like numerals will be used to identify similar features except where expressly otherwise indicated.

FIGS. 1 and 2 show two preferred embodiments of a fence post in accordance with the present invention. The fence post in accordance with the present invention is adapted to release from a substrate surface, in the event of rising water or flood. The fence post, generally designated by the numeral 1 includes an engaging mechanism 2 at a first end of the fence post 1, which is adapted to release the first end 3 from a substrate surface 4 in the event of rising water or flood.

The fence post 1 further includes a retaining mechanism 5, the second end of the fence post 1 which, when the engaging mechanism 2 releases the first end 3 of the fence post 1 from the substrate surface 4, substantially retains the second end 6 at or near its pre-released position.

The retaining mechanism 5 therefore permits movement of the post 1 transverse to the longitudinal axis of the post 1 in at least one dimension, as will described hereafter.

The engaging mechanism 2 may be embodied in a variety of forms. Two examples are shown in FIGS. 1 and 2, but it will be appreciated by persons skilled in the art that the engaging mechanism 2 may be embodied in a variety of other forms. With reference to FIG. 2, the engaging mechanism 2 may include a latch arrangement 7 with a float, such that in the event of a flood or rising waters, the float 8 is adapted to pivot between the positions shown in FIGS. 2*a* and 2*c*, to release the latch 7 from the substrate surface 4 or an anchor 9 connected to the substrate surface 4, to the position shown in FIG. 2*c* in which the lower end 3 of the fence post 1 is no longer secured to the substrate surface anchor 9.

The anchor 9 may have a substrate engaging end 10 which may be secured substantially below the substrate surface 4, and a latch engaging end 11 which effectively enables the first end 3 of the fence post 1 to be secured to the substrate surface 4.

The fence post 1 of the present invention may be formed of hollow plastics material, or other lightweight floatable material. In accordance with a preferred embodiment of the present invention, the body of the fence post 1 may be shaped to assume a substantially buoyant position when floating. For example, in FIG. 1*b* is shown the profile of a typical fence post formed in accordance with the present invention, having lower surfaces 12 and 13 which are adapted to float atop the water, and upper surfaces 14 and 15. The typical water surface might be located as shown by dashed line 16. It will be appreciated by persons skilled in the art that a variety of other shapes may however be utilised in the fence post to achieve a similar purpose.

Figure 4B:
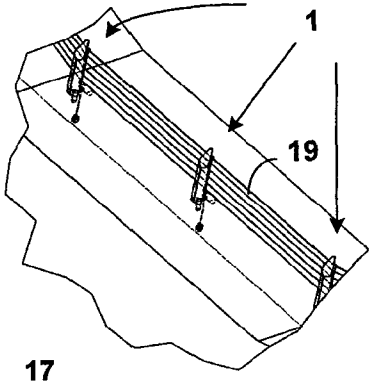
FIGS. 4(*a*) to 4(*c*) illustrate a fence, including a plurality of fence posts of the second embodiment, installed in a dry riverbed situation, FIG. 4(*a*) showing a perspective view, FIG. 4(*b*) showing an enlarged portion of FIG. 4(*a*), and FIG. 4(*c*) showing a side view.
Figure 4A:
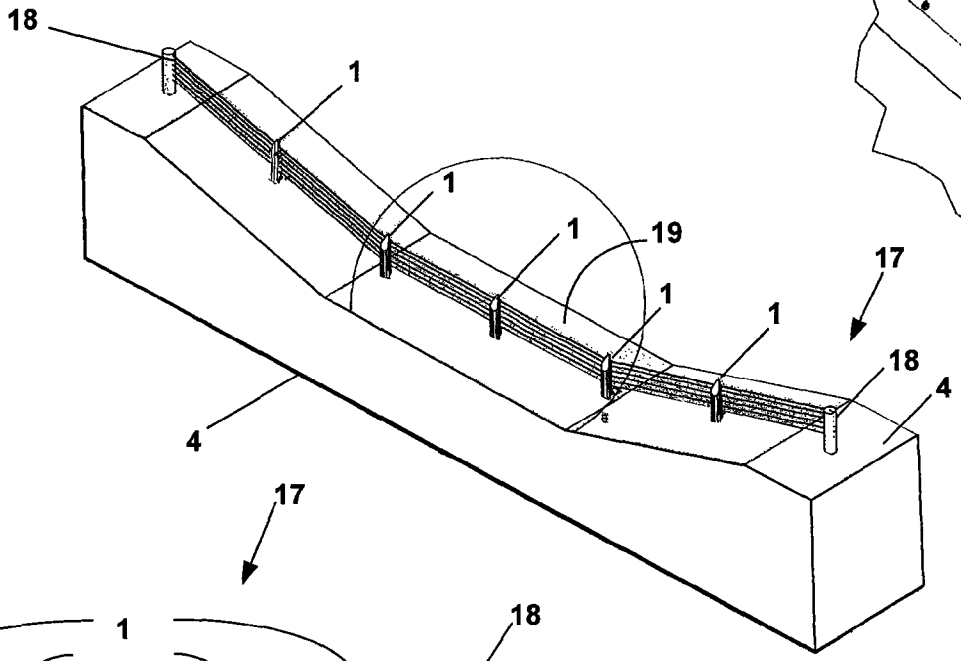
Figure 4C:
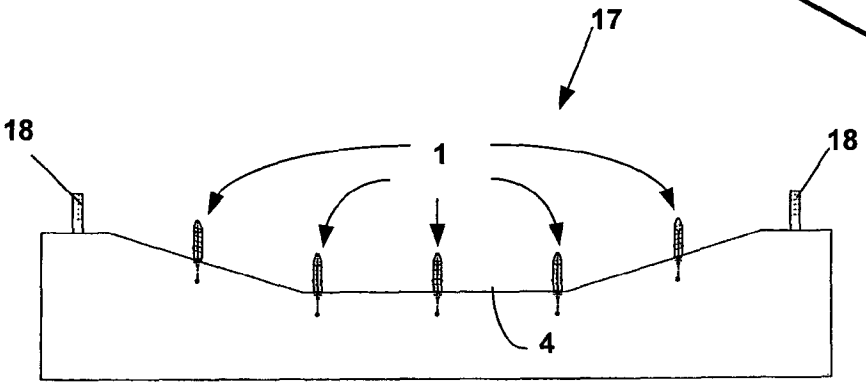

FIGS. 4 and 5 show a fence 17 formed of a plurality of fence posts 1 as hereinbefore described. The particular embodiment described in FIGS. 4 and 5 is in a riverbed or similar situation, that is, of undulating terrain. The fence includes a pair of spaced-apart fixed posts acting as cable supports 18. The support posts 18 are securely fastened to the substrate surface 4. A cable 19, which may be formed of wire rope or otherwise spans the support 18 such that it is spaced above the substrate surface 4. Said cable 19, engages each fence post at retaining mechanism 5. A plurality of releasable posts 1 are positioned intermediate the cable supports 18. Each releasable post 1 is formed as hereinbefore described, having an engaging mechanism 2 at a first end 3 thereof which is adapted to release the first end 3 of the post 1 from the substrate 4 in the event of a flood or raised water, and, a retaining mechanism 5 at a second end 6 thereof, adapted to hold the second end 6 of the post 1 to the cable 19 when the first end 3 of the post 1 is released from the substrate surface 4.

Also as hereinbefore described each engaging mechanism 2 includes a latch 7 which is adapted to float such that in the event of a flood or raised water, the latch 7 is moved from a first position in which the fence post 1 is secured to the substrate 4, to a second position in which the fence post 1 is no longer secured to the substrate 4. This may be achieved using the anchor mechanism as hereinbefore described in relation to FIG. 2, which has a substrate engaging end 10 which is secured substantially below the substrate surface 4, and a latch engaging end 11 which effectively enables a first end 3 of the fence post 1 to be secured to the substrate surface 4.

Figures 5A, 5B, 5C, 5D, 5E:
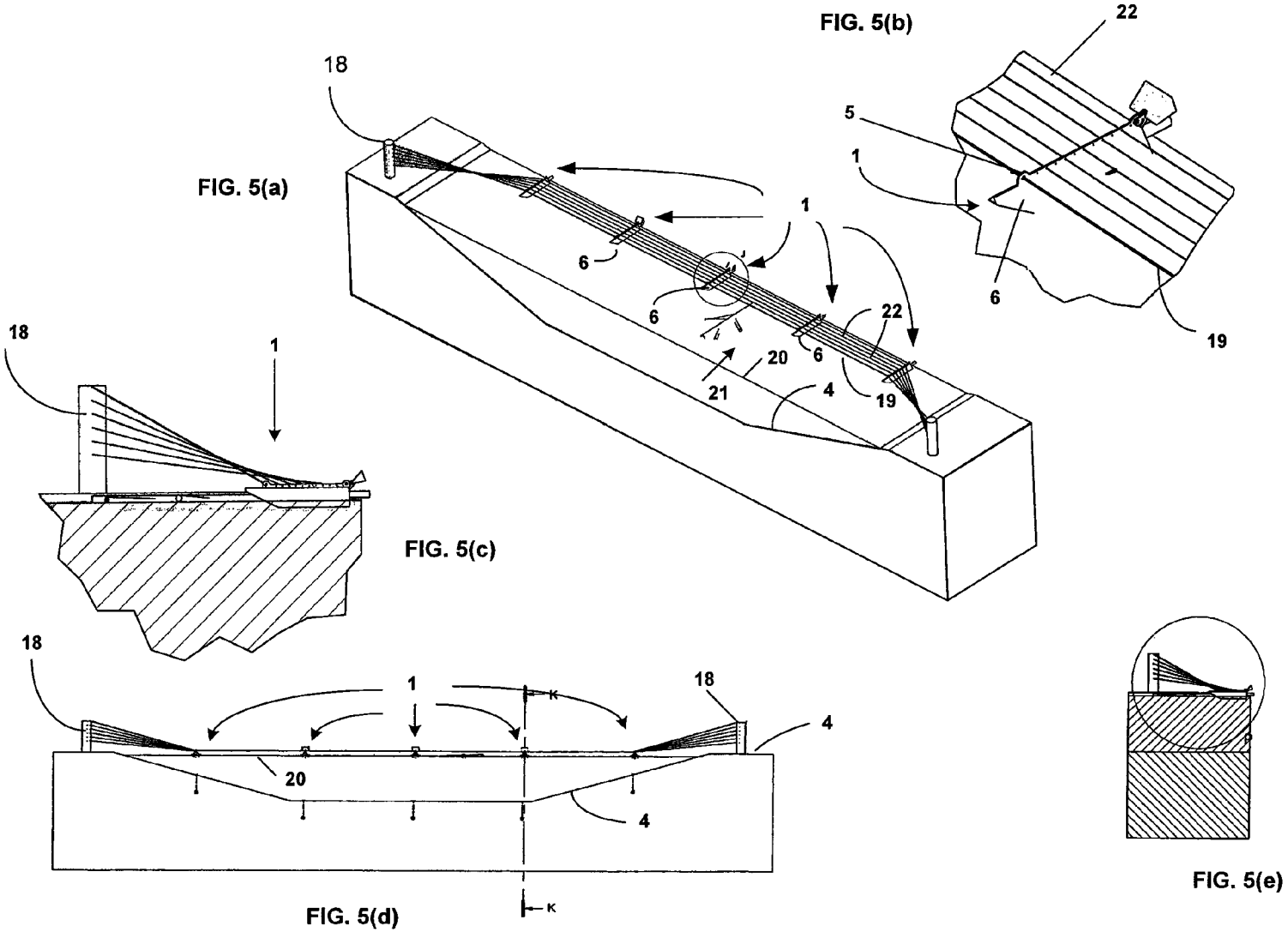
FIGS 5(*a*) to 5(*e*) illustrate a fence, comprising a plurality of fence posts of the second embodiment, installed in a riverbed situation wherein the waters in the riverbed are rising or flooding, FIG. 5(*a*) showing a perspective view, FIG. 5(*b*) showing an enlarged portion of FIG. 5(*a*), FIG. 5(*c*) showing a side view of an end portion of the fence, FIG. 5(*d*) showing a side view of the fence, and FIG. 5(*e*) also showing a side view of an end portion of the fence.
Figure 6F:
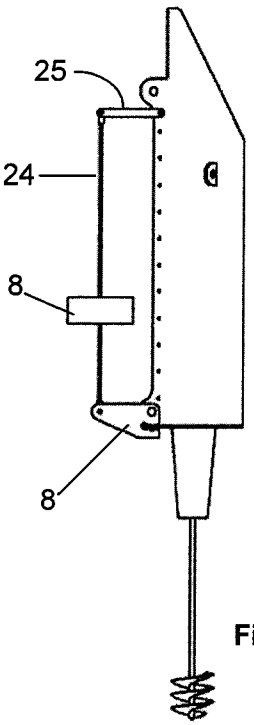
FIGS. 6(*a*) to 6(*f*) illustrate a third preferred embodiment of a fence post in accordance with the present invention, FIG. 6(*a*) showing a first perspective view, FIG. 6(*b*) showing a first side view, FIG. 6(*c*) showing a second perspective view, FIG. 6(*d*) showing a second side view, FIG 6(*e*) showing a perspective view of the third embodiment installed in a substrate, and FIG. 6(*f*) showing the first side view where the latch is in a position found prior to water rising.
Figure 6E:
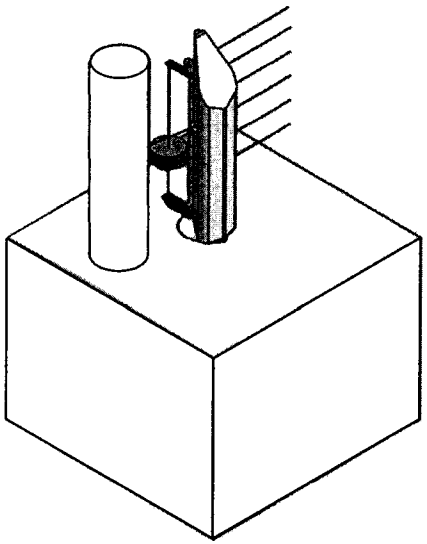
Figure 6C:
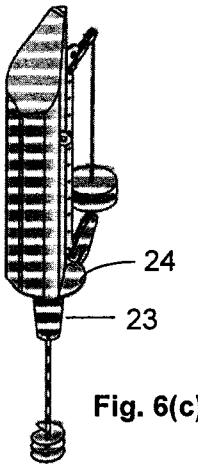
Figure 6D:
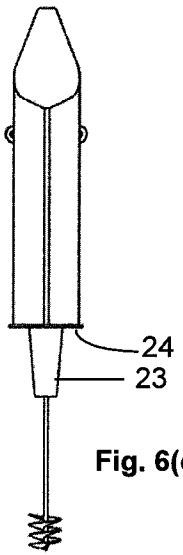
Figure 6A:
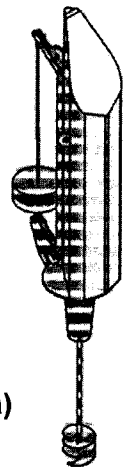
Figure 6B:
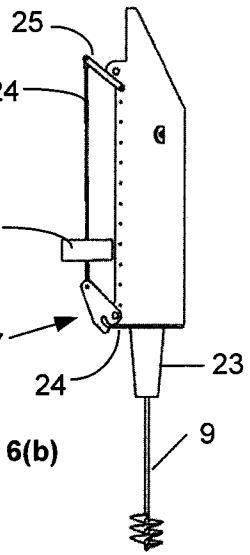

Whilst FIG. 4 shows the fence arrangement when the riverbed or substrate surface 4 is dry, FIG. 5 shows a raised water level 20 showing the typical positioning of the fence 17 in such situation. As seen, when the water is flowing generally in the direction of arrow 20 the raised water level automatically disengages the lower ends 3 of posts 1 from the substrate surface 4, and the fence effectively "floats" on the raised water surface 20. As can been seen from FIG. 5*a*, each fence post 1 therefore "floats" allowing the water and any other debris contained therein to effectively pass under the fence. The "boat-like" shape of the fence posts maintain the fence in a consistent manner as shown in FIG. 5*a* such that the fence wires 22 do not become entangled. As also shown in FIG. 5, due to the direction of flow 21, the fence is shifted slightly downstream, but substantially maintains the fence in a consistent manner. As the water level recedes, the fence will likewise float down. The fence posts may therefore be easily reattached to the substrate using the latch once the water level has totally receded.

It will be appreciated that this arrangement results in the quick and easy repositioning of the fence after a flood situation rather than a whole new fence having to be effectively rebuilt.

FIGS. 6 and 7 illustrate an alternative preferred embodiment of the fence post in accordance with the present invention. In this version, the engaging mechanism 2 at the first end of each fence post 1 is adapted to be inserted in a respective complementary post receiver 23 which is anchored into the substrate surface. Each post receiver 23 has a tapered portion to receive the engaging portion 2 of the respective post 1, and, a lip or the like therearound 24 to which the latch 7 may be engaged. A different version of a float 8 is shown in FIGS. 6 and 7, the float being secured to a rod or cable arrangement 24 which is itself adapted to undergo movement, being connected at it ends by latch 7 and arm 25. It will therefore be appreciated that the arrangement formed by latch 7, arm 25 and its interconnected members 24 and float 28 will be able to undergo pivotal movement from the position shown in FIG. 6(*f*) to the position shown in FIG. 6(*b*) as the water rises. This is further illustrated in FIG. 7 as is the different arrangement of ground engaging portion.

Figures 8A, 8B, 8C:
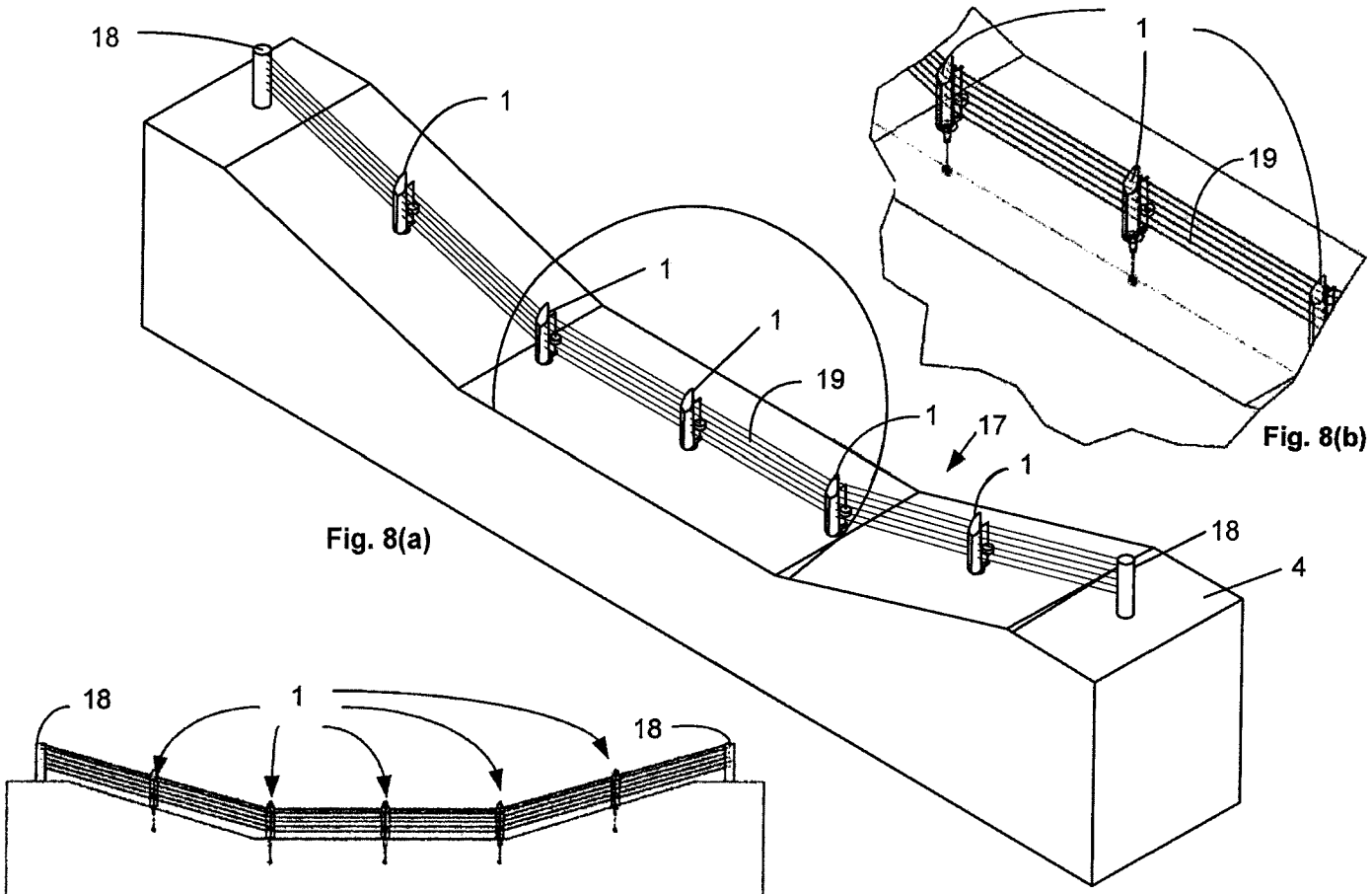
FIGS. 8*a*) to 8(*c*) illustrate a fence, including a plurality of fence posts of the third embodiment, installed in a dry riverbed situation, FIG. 8(*a*) showing a perspective view, FIG. 8(*b*) showing an enlarged portion of FIG. 8(*a*), and FIG. 8(*c*) showing a side view.
Figures 9A, 9B, 9C, 9D, 9E:
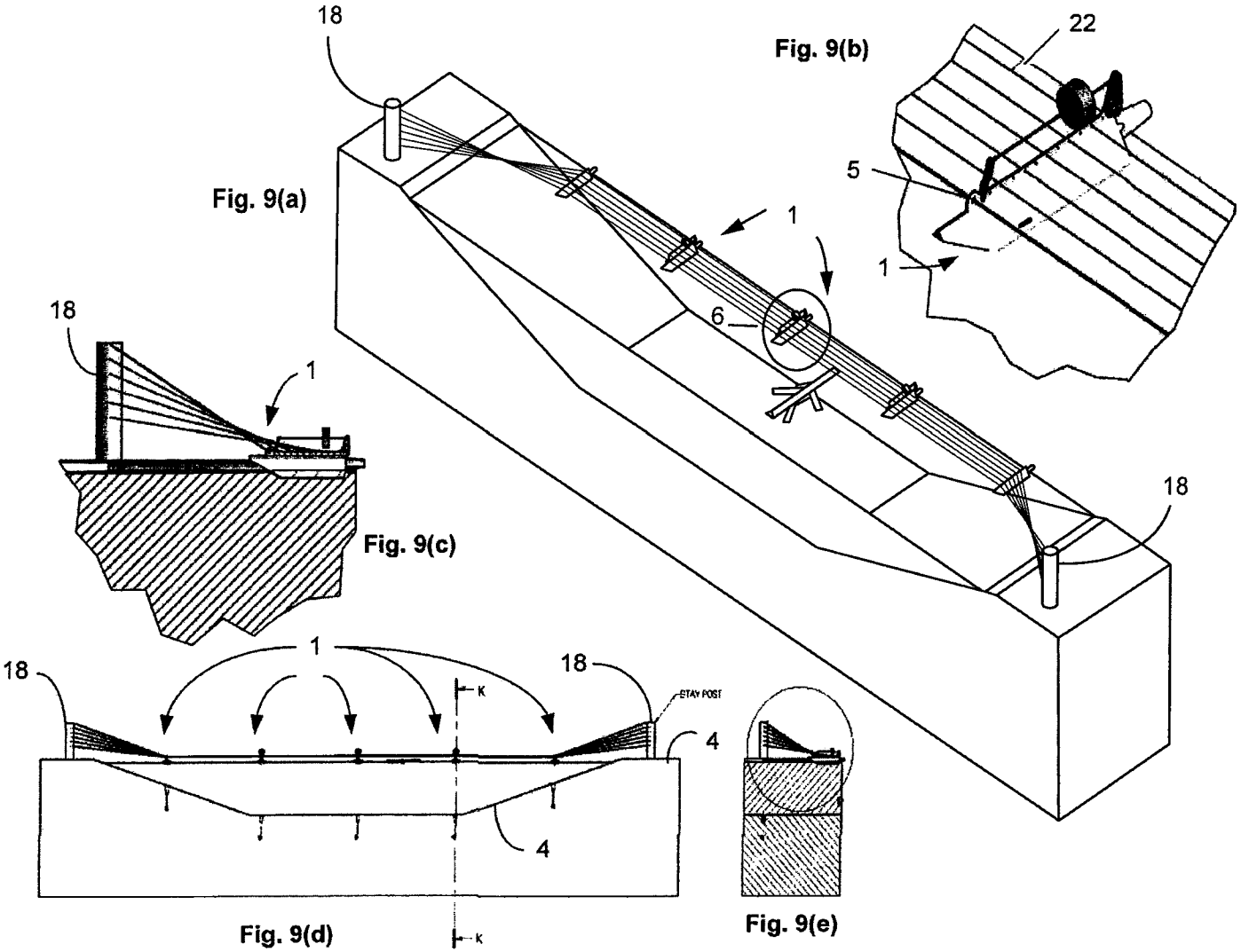
FIGS. 9(*a*) to 9(*e*) illustrate a fence, including a plurality of fence posts of the third embodiment, wherein the waters in a riverbed are rising or flooding, FIG. 9(*a*) showing a perspective view, FIG. 9(*b*) showing an enlarged portion of FIG. 9(*a*), FIG. 9(*c*) showing a side view of an end of the fence, FIG. 9(*d*) showing a side view, and FIG. 9(*e*) showing a side view of an end of the fence.

FIGS. 8 and 9 show a fence 17 formed of a plurality of fence posts 1 as hereinbefore described, using the embodiment of fence posts as illustrated in FIGS. 6 and 7. Operation of the device is similar to that as hereinbefore described in relation to FIGS. 4 and 5.

It will be appreciated by persons skilled in the art that numerous variations and modifications will become apparent. For example, different types of latching mechanisms etc will be envisaged. The releasable posts, rather than being secured at their upper ends by a cable running therethrough, may alternatively be individually pivoted and secured to their own support posts. Such an arrangement might enable the automatic repositioning of the fence post after a flood situation without requiring manual assistance.

These and all other variations and modifications which become apparent to persons skilled in the art should be considered to fall within the spirit and scope of the invention as broadly herein before described and as hereinafter claimed.

The invention claimed is:

1. A fence post assembly adapted to be releasably anchored to a substrate surface, the fence post assembly comprising:

an anchor that is adapted to be installed in the substrate surface;

a fence post including an elongate fence post body having a first end that is adapted to be positioned in the substrate surface and a second end opposite the first end;

an anchor engaging mechanism near the first end of the post body, the anchor engaging mechanism comprising a latch which is moveable from a first position in which the fence post body is secured to the anchor to a second position in which the fence post body is released from the anchor; and a float operatively connected to the latch the float being formed at least partly of buoyant material, to effect operation of the latch in the event of rising water or flood, wherein the float is coupled to the anchor engaging mechanism so that as water rises, the float moves toward the second end of the post body to supply an upward force on the engaging mechanism to move and disengage the latch from the anchor so that the post body can begin to float while anchor remains in the substrate;

wherein said float includes a buoyant body portion which is pivotally attached to said first end of said post, such that, in the event of rising water or food, said buoyant body portion rises to effect pivotal operation of said latch to thereby release said post from said anchor; and wherein said float includes a buoyant body portion installed on an interconnecting rod between said latch and an arm, wherein each of said latch and said arm is pivotally connected at spaced apart locations to said post, such that, in the event of rising water or flood of a predetermined depth above said substrate surface, said float rises to effect pivotal operation of said latch to thereby release said post from said anchor.

2. The fence post assembly as claimed in claim 1, further including comprising:

a retaining mechanism at a second end thereof, which, when said engaging mechanism releases said first end of said fence post from said substrate surface, substantially retains said second end of said post at or near its pre-released position.

3. The fence post assembly as claimed in claim 2, wherein said retaining means mechanism permits transverse movement of said post in at least one dimension.

4. The fence post assembly as claimed in claim 1, wherein said first end of said post body is shaped to be received in a post receiving portion of said anchor.

5. The fence post assembly as claimed in claim 1 wherein said fence post body is formed substantially of a floatable material.

6. A fence having comprising:

a plurality of fence posts, at least one of said fence posts being a fence post formed of substantially buoyant material, adapted to be releasably secured to an anchor installed in a substrate surface in a substantially upright manner and which in the event of rising water or flood releases from said anchor;

an anchor engaging mechanism at a first end of said post including a latch, which is movable from a first position in which said fence post is secured to said anchor, to a second position in which said fence post is released from said anchor; and a float operatively connected to said latch said float being formed at least partly of buoyant material to effect operation of said latch in the event of rising water or flood causes the float to rise and move the latch to the second position to release the anchor;

wherein said float includes a buoyant body portion which is pivotally attached to said first end of said post, such that, in the event of rising water or food, said buoyant body portion rises to effect pivotal operation of said latch to thereby release said post from said anchor; and wherein said float includes a buoyant body portion installed on an interconnecting rod between said latch and an arm, wherein each of said latch and said arm is pivotally connected at spaced apart locations to said post, such that, in the event of rising water or flood of a predetermined depth above said substrate surface, said float rises to effect pivotal operation of said latch to thereby release said post from said anchor.

7. The fence as claimed in claim 6, wherein each releasable fence post has its first end shaped to be received in a post receiving portion of a respective anchor.

8. The fence as claimed in claim 7, wherein each releasable fence post further comprises:

a retaining mechanism at a second end thereof, which, when said engaging mechanism releases said first end of said fence post from said substrate surface, substantially retains said second end of said post at or near its pre-released position.

9. The fence as claimed in claim 8, further comprising:

a pair of spaced apart cable supports; and, a cable spanning said cable supports in a manner such that it is spaced above a substrate surface;

whereby, said retaining mechanism of each releasable fence post engages said cable.

10. A fence having:

a pair of spaced apart cable supports;

a cable spanning said cable supports in a manner such that it is spaced above a substrate surface;

at least one releasable post positioned between said cable supports, the releasable post being formed of substantially buoyant material and comprising an elongate fence post body having a first end that is adapted to be positioned in the substrate surface and a second end opposite the first end;

an anchor engaging mechanism near the first end of the post body, the anchor engaging mechanism comprising a latch which is moveable from a first position in which the fence post body is secured to the anchor to a second position in which the fence post body is released from the anchor; and a float operatively connected to the latch, the float being formed at least partly of buoyant material to effect operation of the latch in the event of rising water or flood, wherein the float is coupled to the anchor engaging mechanism so that as water rises, the float moves toward the second end of the post body to supply an upward force on the engaging mechanism to move and disengage the latch from the anchor so that the post body can begin to float while anchor remains in the substrate;

wherein said float includes a buoyant body portion which is pivotally attached to said first end of said post, such that, in the event of rising water or food, said buoyant body portion rises to effect pivotal operation of said latch to thereby release said post from said anchor; and wherein said float includes a buoyant body portion installed on an interconnecting rod between said latch and an arm, wherein each of said latch and said arm is pivotally connected at spaced apart locations to said post, such that, in the event of rising water or flood of a predetermined depth above said substrate surface, said float rises to effect pivotal operation of said latch to thereby release said post from said anchor.

11. The fence as claimed in claim 10, wherein each said first end of said releasable post is shaped to be received in a post receiving portion of said anchor.

12. The fence as claimed in claim 11, wherein each releasable fence post is formed substantially of a floatable material.

* * * * *